US007285062B2

(12) United States Patent
McMillan et al.

(10) Patent No.: US 7,285,062 B2
(45) Date of Patent: Oct. 23, 2007

(54) RACQUET HAVING CANTILEVERED HOOP PORTIONS

(75) Inventors: Willie H. McMillan, Bolingbrook, IL (US); William D. Severa, Darien, IL (US); Donald G. Loeffler, Gilberts, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 61 days.

(21) Appl. No.: 11/324,606

(22) Filed: Jan. 3, 2006

(65) Prior Publication Data

US 2007/0155547 A1 Jul. 5, 2007

(51) Int. Cl.
*A63B 49/02* (2006.01)

(52) U.S. Cl. ..... 473/540; 473/524

(58) Field of Classification Search ..... 473/540, 473/524, 542, 543, 534
See application file for complete search history.

(56) References Cited

U.S. PATENT DOCUMENTS

| | | | | |
|---|---|---|---|---|
| 2,626,804 | A | 1/1953 | Robinson | |
| 2,878,020 | A * | 3/1959 | Robinson | 473/535 |
| 3,904,202 | A | 9/1975 | DeLorean | |
| 4,102,533 | A | 7/1978 | Ida | |
| 4,135,717 | A | 1/1979 | DiLeo | |
| 4,613,138 | A | 9/1986 | Haythornthwaite | |
| 4,655,455 | A * | 4/1987 | Kurusu | 473/548 |
| 4,861,029 | A * | 8/1989 | Takatsuka | 473/540 |
| 5,029,857 | A * | 7/1991 | von Hackewitz | 473/534 |
| 5,137,273 | A * | 8/1992 | Jseng | 473/543 |
| 5,458,331 | A | 10/1995 | Bothwell | |
| 6,530,851 | B2 | 3/2003 | Munster | |
| 2002/0142869 | A1 | 10/2002 | Nevers | |

FOREIGN PATENT DOCUMENTS

JP P2002-191723 A * 7/2002

* cited by examiner

*Primary Examiner*—Raleigh W. Chiu
(74) *Attorney, Agent, or Firm*—Terence P. O'Brien

(57) ABSTRACT

A sports racquet including a frame, a string bed, and at least one cantilevered member. The frame includes a head portion coupled to a handle portion. The head portion includes a distal region, first and second side regions, and a proximal region. A string bed is formed of a plurality of cross string segments and a plurality of main string segments. The cantilevered member has a first section coupled to one of the regions, such that at least one point on the first section remains substantially fixed in relation to the region to which the first section is coupled, and a second section that is deflectable relative to the region to which the first section is coupled. At least one of the string segments is operably engaged with the member, such that when a ball impacts the string segment, the second section deflects inward toward the string bed.

35 Claims, 18 Drawing Sheets

RACQUET HAVING CANTILEVERED HOOP PORTIONS

FIELD OF THE INVENTION

The present invention relates generally to a sports racquet. In particular, the present invention relates to racquet including a head portion having at least one cantilevered member.

BACKGROUND OF THE INVENTION

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Many racquets also include a throat portion positioned between and connecting the handle portion to the head portion. The typical string bed of a sports racquet includes a central region, that provides the most responsiveness, the greatest power and the best "feel" to the player, upon impact with a ball, and a peripheral region. The central region, commonly referred to as the "sweet spot," is typically defined as the area of the string bed that produces higher coefficient of restitution ("COR") values. A higher COR generally directly corresponds to greater power and greater responsiveness.

Generally speaking, the size of the sweet spot of a racquet will increase with increased string segment length. The longer string segments enable the string bed to deflect more when impacting a ball and provide a longer "dwell time" between the string bed and the ball upon impact. The increased "dwell time" improves not only the responsiveness of a racquet, but also its control, including the ability to impart spin on the ball.

Some existing racquets incorporate a larger sized hoop portion supporting a larger sized string bed (i.e., a larger head size) in an effort to increase the size of the string bed and the sweet spot. However, as the head size of a racquet increases, so does the polar moment of inertia of the racquet. A racquet with a higher polar moment of inertia can be more difficult to maneuver, particularly at the net or upon return of serve, than a racquet with a lower moment of inertia. Additionally, some users find a large head racquets to be more difficult to swing than racquets with normal sized heads.

Other racquets have incorporated different head shapes in an effort to increase the length of certain main or cross string segments, without increasing the size of all of the main and cross-string segments. Although such designs can provide a more targeted approach to increasing the performance of the racquet, such designs can also result in an undesirable increase in the polar moment of inertia of the racquet. Further, such designs may also result in a head size that has an undesirable appearance, or an appearance that is markedly different from the look and design of traditional sport racquet designs.

Thus, there is a continuing need for a racquet having a string bed with an enlarged sweet spot and providing an increased "dwell time," without negatively effecting the overall performance of the racquet. It would be advantageous to provide a racquet with an enlarged sweet spot and an increased "dwell time" without increasing the polar moment of inertia of the racquet head and without negatively affecting the maneuverability of the racquet. It would also be advantageous to provide a means for targeting certain main and/or cross string segments in an effort to optimize the performance of a particular racquet design, without increasing the polar moment of inertia of the racquet head and without negatively affecting the maneuverability of the racquet. There is also a need for a racquet having a string bed with an enlarged sweet spot that is not a radical departure in look and design from traditional sport racquet designs.

SUMMARY OF THE INVENTION

The present invention provides a sports racquet for impacting a game ball. The sports racquet including a frame, a string bed, and at least one cantilevered member. The frame includes a head portion coupled to a handle portion. The head portion includes a distal region, first and second side regions, and a proximal region. A string bed is formed of a plurality of cross string segments and a plurality of main string segments. The cantilevered member has a first section coupled to one of the regions of the head portion, such that at least one point on the first section remains substantially fixed in relation to the region to which the first section is coupled, and a second section that is deflectable relative to the region to which the first section is coupled. At least one of the string segments is operably engaged with the at least one member, such that when the ball impacts the at least one string segment, the second section of the member deflects inward toward the string bed.

According to a principal aspect of the invention, a sports racquet is configured for impacting a game ball and to support a string bed formed of a plurality of cross string segments and a plurality of main string segments. The racquet includes a frame and at least one cantilevered member having first and second sections. The frame includes a head portion coupled to a handle portion. The head portion includes a distal region, first and second side regions, and a proximal region. The first section of the at least one cantilevered member is coupled to the at least one of the regions of the head portion such that at least one point on the first section remains substantially fixed in relation to the region to which the first section is coupled. The cantilevered member has a second section that is unconnected, and movable relative, to the region to which the first section is coupled. At least one of the string segments is operably engaged with the second section of the at least one member, such that when the ball impacts the at least one string segment, the second section of the member moves inward toward the string bed.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
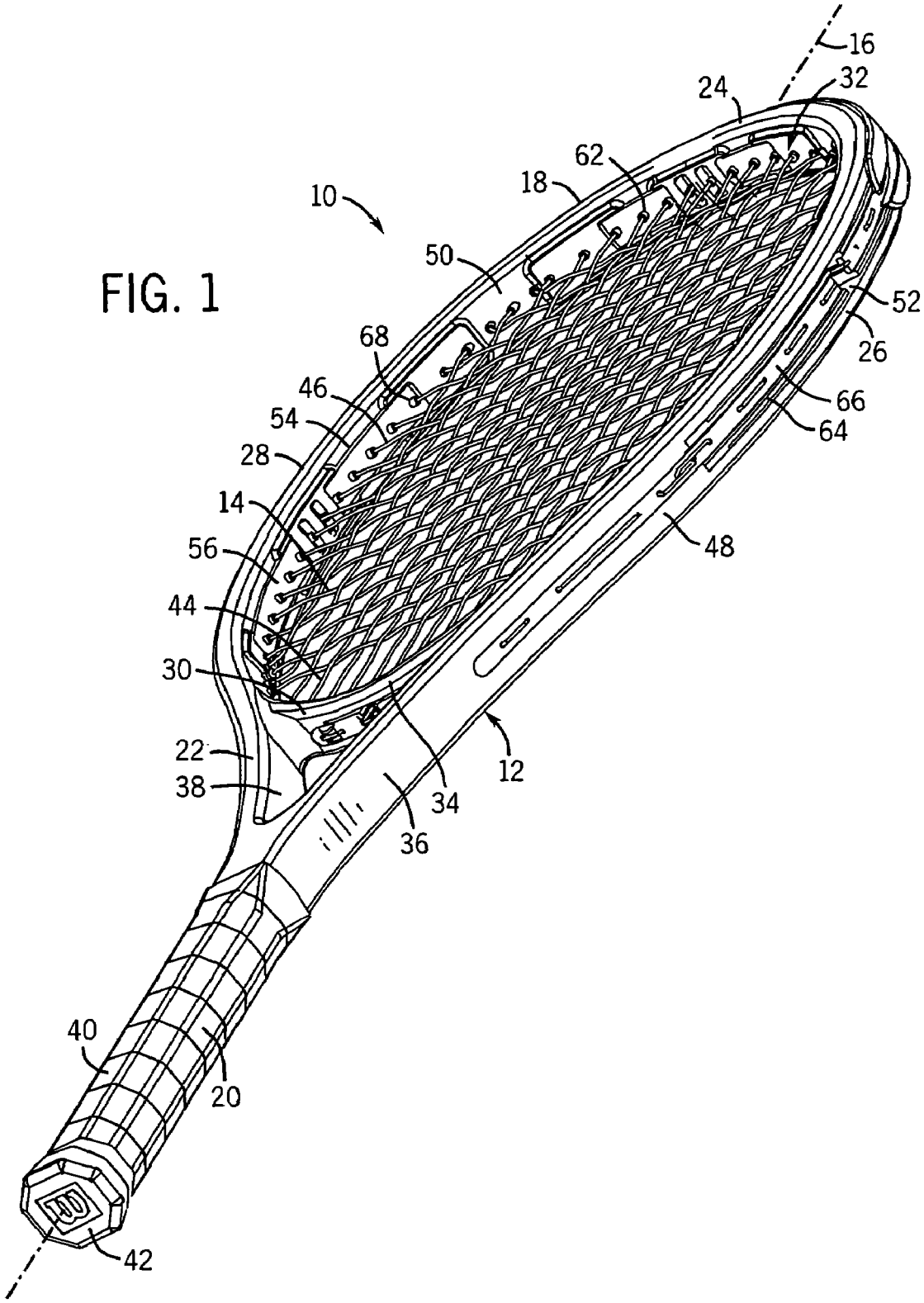
FIG. 1 is a front side perspective view of a racquet in accordance with a preferred embodiment of the present invention.
Figure 2:
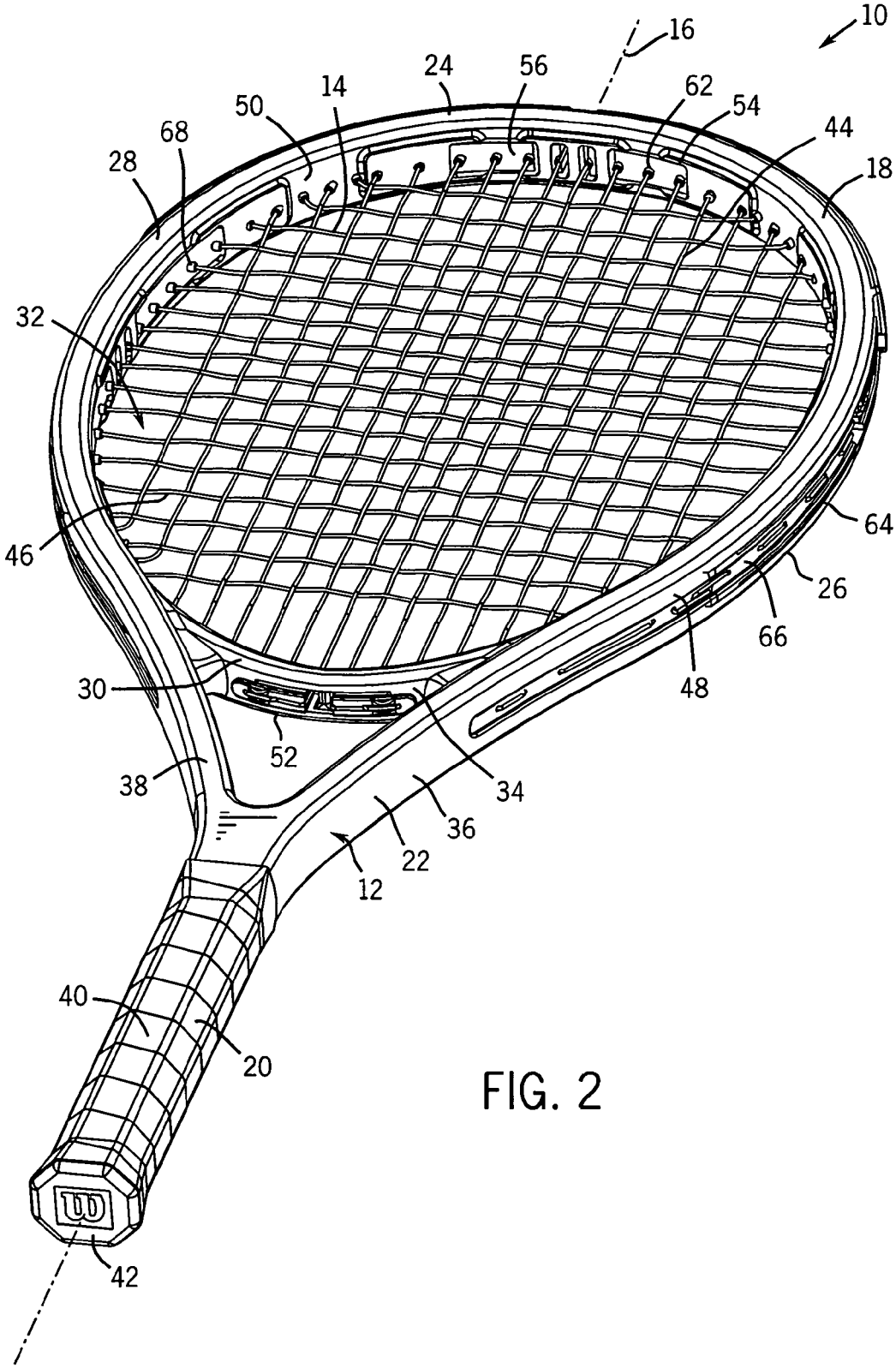
FIG. 2 is a front perspective view of the racquet of FIG. 1.

Referring to FIGS. 1 and 2, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame 12 and a string bed 14. The frame 12 is a tubular structure having a longitudinal axis 16 and including a head portion 18, a handle portion 20, and a throat portion 22 coupling the head and handle portions 18 and 20. The frame 12 is formed of a lightweight, durable material, preferably a carbon-fiber composite material. Alternatively, the frame 12 can be formed of other materials including metallic alloys, other composite materials, wood, or combinations thereof. The head portion 18 forms a distal region 24, first and second side regions 26 and 28, and a proximal region 30, which collectively define a string bed area 32 for receiving and supporting the string bed 14. In one preferred embodiment, the proximal region 30 includes a yoke 34.

The yoke 34 is an elongate tubular structural member which extends from the first side region 26 to the second side region 28 of the head portion 18. In one preferred embodiment, the yoke 34 is integrally formed with the frame 12 defining the proximal region 30. In alternative preferred embodiments, the yoke 34 can be connected through use of adhesives, fasteners, bonding and combinations thereof. In another embodiment, the yoke 34 can separated from the frame 12 by vibration absorbing material, such as, for example, an elastomer. The yoke 34 is formed of a lightweight, durable material, preferably a carbon-fiber composite material. Alternatively, the yoke 34 can be formed of other materials, such as, for example, metallic alloys, other composite materials, and combinations thereof. The yoke 34 provides structural support to the frame 12, as well as a means for defining the lower portion of the string bed area 24 and a support for engaging, routing or directing the main string segments. In another alternative preferred embodiment, the frame 12 of the racquet 10 can be formed without a yoke.

In a preferred embodiment, the first and second side regions 26 and 28 downwardly extend from the head portion 18 to form first and second throat tubes 36 and 38 of the throat portion 22. The first and second throat tubes 36 and 38 converge further downwardly extend to form the handle portion 20. The handle portion 20 includes a pallet (not shown), a grip 40 and a butt cap 42. In alternative preferred embodiments, the handle portion 20 can be a tubular structure that does not include an extension of the first and second throat tubes. In this alternative preferred embodiment, the handle portion can be a tubular structure separate from either the throat portion or the head portion of the frame and attached to the throat portion through use of conventional fasteners, molding techniques, bonding techniques, adhesives or combinations thereof.

In another preferred embodiment, the head portion 18 is directly connected to one or both of the throat portion 22 and the yoke 34 through the use of conventional fasteners, adhesives, mechanical bonding, thermal bonding, or other combinations thereof. Alternatively, the head portion 18 can be separated from one or both of the throat portion and the yoke by a vibration and shock absorbing material, such as an elastomer. In yet another alternative preferred embodiment, the head portion 18 is integrally formed with one or both of the throat portion 22 and the yoke 16.

The string bed 14 is formed by a plurality of main string segments 44 interwoven with a plurality of cross string segments 46. The main and cross string segments 44 and 46 can be formed from one continuous piece of racquet string, or from two or more pieces of racquet string.

Figure 3:
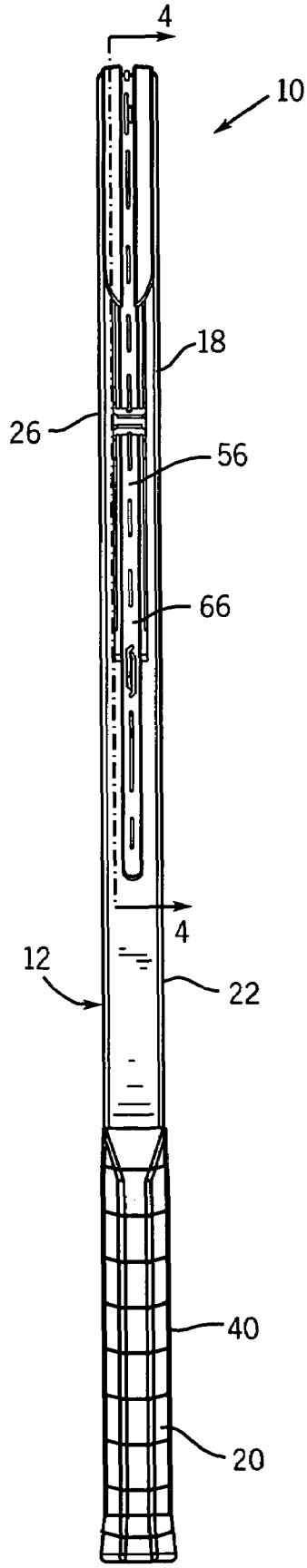
FIG. 3 is a side view of the racquet of FIG. 1.

Referring to FIGS. 1-3, the head portion 18 of the racquet 10 is preferably a tubular structure shaped to define a hoop. The hoop can be any closed curved shape including, for example, a generally oval shape, a generally tear-drop shape, a generally pear shape, a generally circular shape and combinations thereof. The head portion 18 includes an outer wall 48 and an inner wall 50. In a preferred embodiment, the head portion 18 includes a plurality of outer and inner wall openings 52 and 54 in the outer and inner walls 48 and 50, respectively, generally corresponding the location of a plurality of cantilevered members 56.

Figure 4:
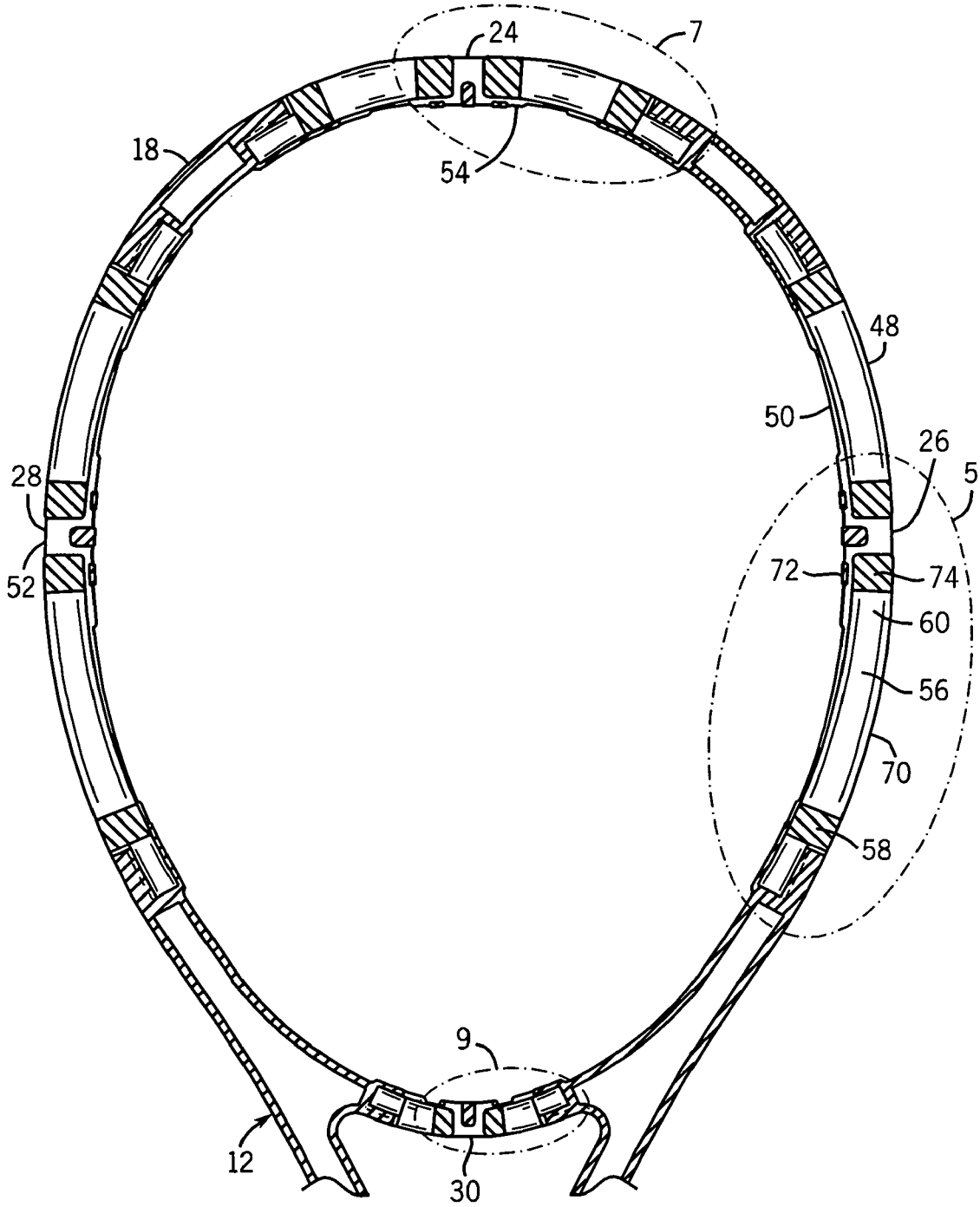
FIG. 4 is a front sectional view of the head portion of the racquet as viewed from line 4-4 of FIG. 3, shown in a strung position but without racquet string.

Referring to FIGS. 2 and 4, the head portion 18 is shown in greater detail. Each of the distal region 24, the first and second side regions 26 and 28 and the proximal region 30 includes one of the outer wall openings 52 and at least one inner wall opening 54, and each outer wall opening 52 is sized to expose a portion of two cantilevered members 56. The outer and inner wall openings 52 and 54 allow access to the cantilevered members 56 and enable at least a portion of the cantilevered members 56 to be visible outside of the head portion 18. The outer and inner wall openings 52 and 54 can also be used for facilitating assembly, replacement or adjustment of the cantilevered members 56 within the head portion 18. Further, the outer wall openings 52 can be configured to enable at least a portion of the cantilevered member 56 to extend beyond the outer periphery of the hoop portion 18.

In alternative preferred embodiments, the head portion 18 can be formed without inner or outer wall openings corresponding to the cantilevered member, such that the cantilevered members operate within the head portion without being accessible or visible through one or more openings. In other alternative preferred embodiment, a separate opening or openings can be defined for each cantilevered member. Further, the openings can be formed solely in either the outer wall or the inner wall, and, in other alternative embodiments, the openings can take the shape of a slot or other shape.

The cantilevered members 56 are elongate levers preferably shaped to generally conform to the shape of the head portion 18. Each cantilevered member 56 is preferably a one piece structure. Alternatively, each cantilevered member can be formed of two or more pieces. The cantilevered members 56 include a first section 58 coupled to the head portion 18 and a second section 60 extending from the first section 58. The cantilevered members 56 are preferably press-fit to the frame 12. In this configuration, at least one point on the first section 58 remains substantially fixed in relation to the head portion 18. In alternative preferred embodiments, the cantilevered members 56 can be fixedly coupled to the head portion 18 through other means, such as, for example, other press-fit connections, conventional fasteners, adhesives, bonding and combinations thereof. In another alternative preferred embodiment, the one or more cantilevered members 56 can be integrally formed with the head portion 18. In another alternative preferred embodiment, the cantilevered members 56 can be pivotally or movably coupled to the head portion 18 (see FIG. 12 discussed below).

The cantilevered members 56 are formed of a lightweight, durable and resilient material, preferably, nylon. Alternatively, the cantilevered members can be formed of other materials, such as, for example, a composite material, a urethane, a polyamide, a rubber, wood, aluminum, other metals, other polymeric materials and combinations thereof. In one preferred embodiment, the cantilevered member 56 can be elastically deflectable such that the second section 60 of the cantilevered member 56 deflects or bows with respect to the head portion 18 when a load is applied to the second section of the cantilevered member 56 through the string bed 14. In another alternative preferred embodiment, the cantilevered members are formed of a generally rigid material, and the cantilevered member pivots or otherwise moves with respect to cantilevered member upon the application of load.

Figure 5:
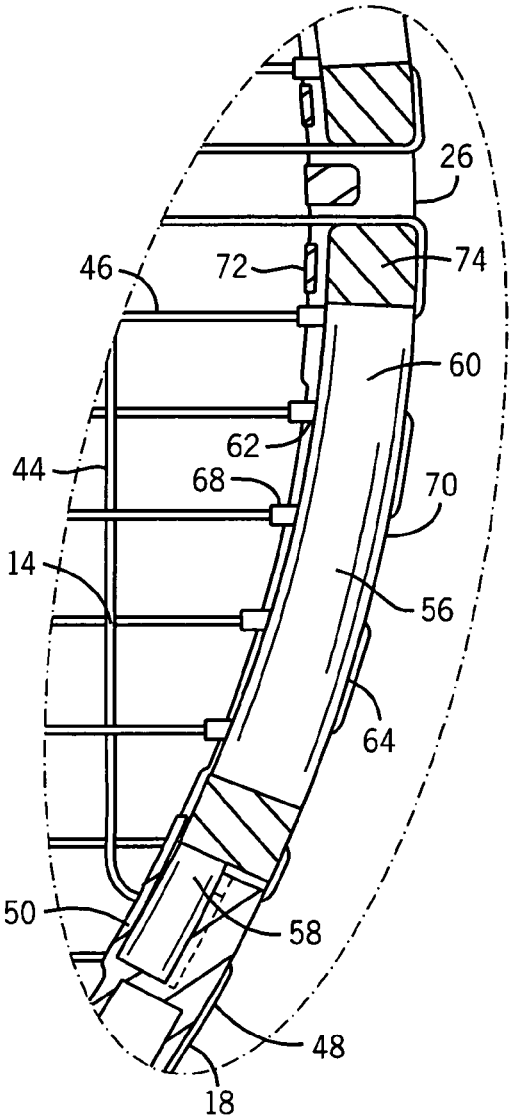
FIG. 5 is an enlarged front view of a first side region of the head portion viewed from oval 5 of FIG. 4, wherein the head portion includes racquet string and is shown in a condition prior to impact with a ball.

Referring to FIGS. 1, 2 and 5, the cantilevered member 56 includes at least one string hole 62 for receiving and engaging at least one main or cross string segment 44 and 46. Preferably, the cantilevered member 56 includes two or more string holes 62 depending upon its length. For example, as shown in FIG. 5, the cantilevered member 56 coupled to the first side region 26 includes six string holes. Preferably, the cantilevered member 56 further includes a string groove 64 formed into its outer surface for guiding the string segment(s) between the string holes 62. In one preferred embodiment, a grommet strip 66 is engaged with the cantilevered member 56. The grommet strip 66, which includes two more grommets 68 extending through the string holes 62, protects the string segments from wearing or abrading against the surfaces of the cantilevered member 56. Alternatively, the cantilevered member 56 can be used without grommets or a grommet strip.

Figure 6:
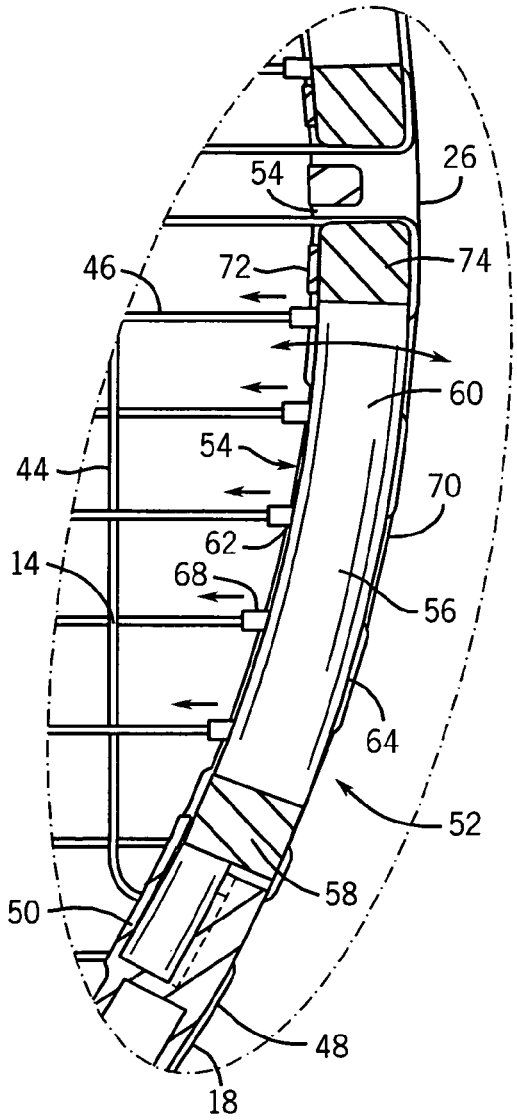
FIG. 6 is an enlarged front view of the first side region of the head portion viewed from oval 5 of FIG. 4, wherein the head portion includes racquet string and is shown in a condition during impact with a ball.
Figure 7:
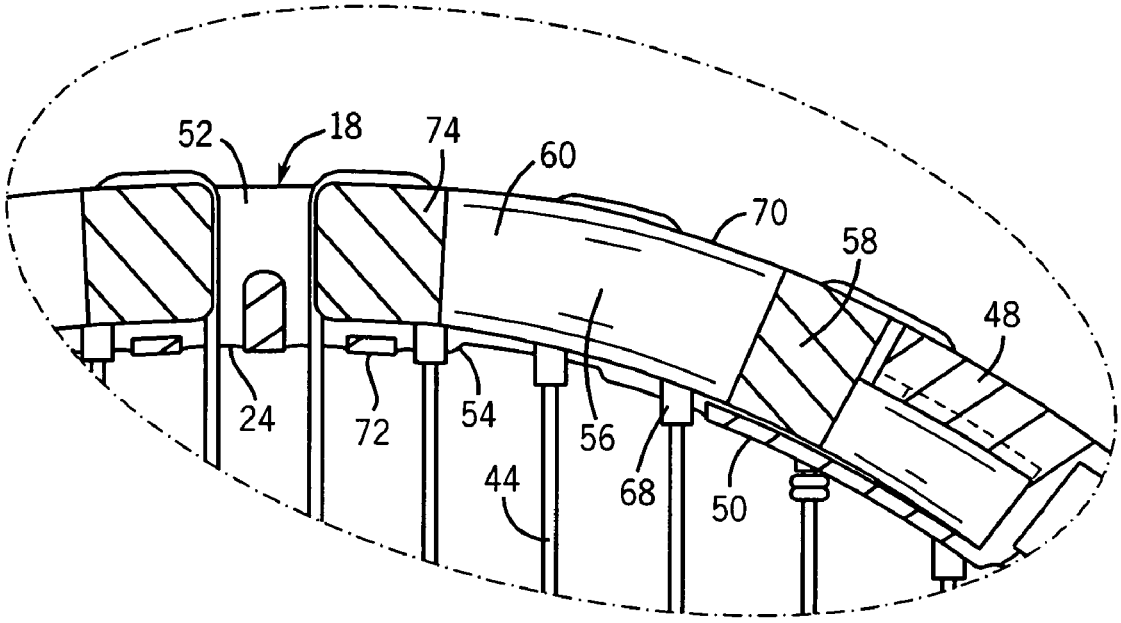
FIG. 7 is an enlarged front view of a distal region of the head portion viewed from oval 7 of FIG. 4, wherein the head portion includes racquet string and is shown in a condition prior to impact with a ball.
Figure 8:
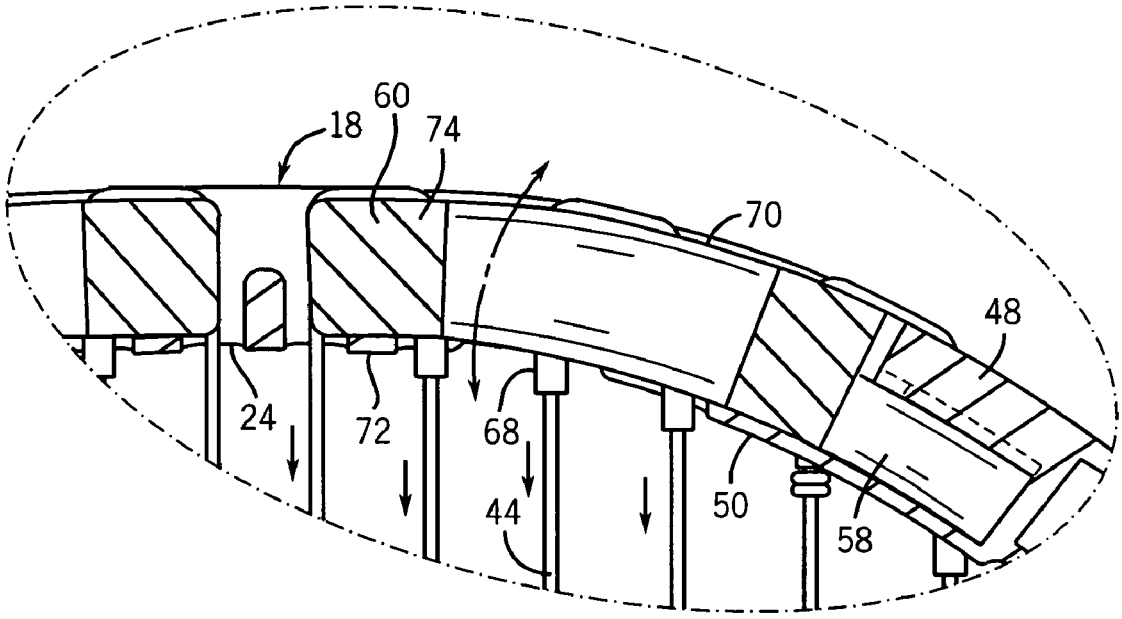
FIG. 8 is an enlarged front view of the distal region of the head portion viewed from oval 7 of FIG. 4, wherein the head portion includes racquet string and is shown in a condition during impact with a ball.
Figure 9:
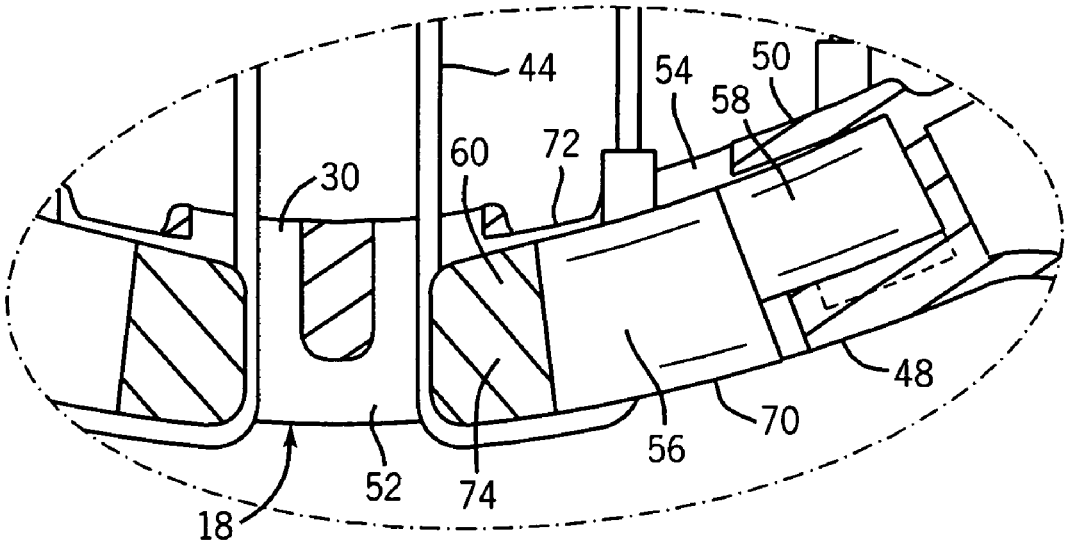
FIG. 9 is an enlarged front view of a proximal region of the head portion viewed from oval 9 of FIG. 4, wherein the head portion includes racquet string and is shown in a condition prior to impact with a ball.
Figure 10:
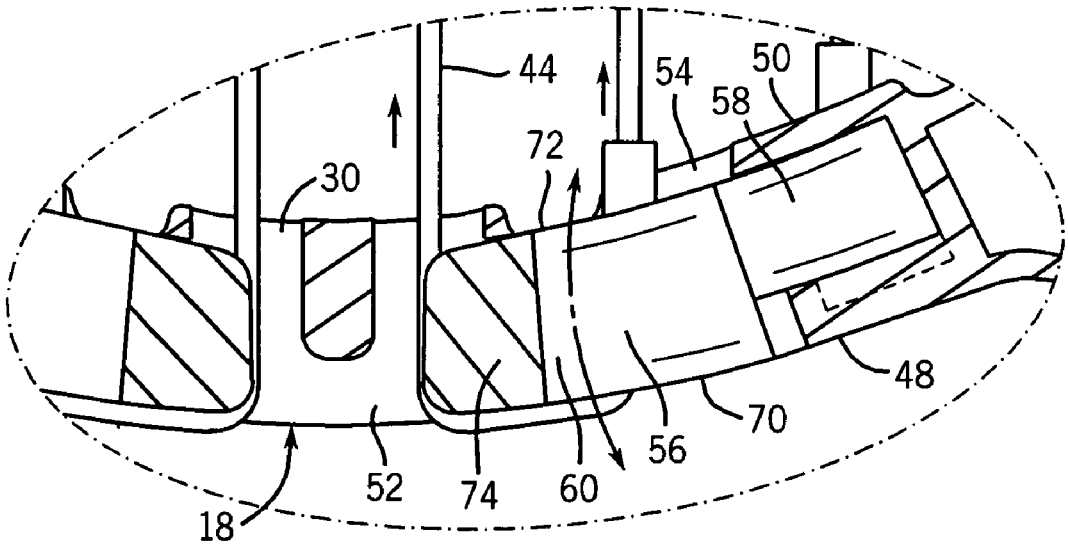
FIG. 10 is an enlarged front view of the proximal region of the head portion viewed from oval 9 of FIG. 4, wherein the head portion includes racquet string and is shown in a condition during impact with a ball.

Referring to FIGS. 5 and 6, the operation of one of the cantilevered members 56 is illustrated. Referring to FIG. 5, the cantilevered member 56 is shown with the first section 58 fixedly secured to the head portion 18, and the second section 60 extending along the head portion 18 such that the outer surface 70 of the cantilevered member 56 generally conforms with the contour or shape of the outer wall 48 of the head portion 18. The outer wall opening 52 exposes a large amount of the second section 60 of the cantilevered member 56 and the inner wall openings 54 expose portions of an inner surface of the section 60. Preferably, the head portion 18 further includes at least one stop 72 formed into, or attached to, the head portion 18. The stop 72 serves to inhibit the inward deflection or travel of the second section 60 of the cantilevered member 56.

Referring to FIG. 4, the cantilevered members 56 positioned within the distal, proximal and first and second side regions 24, 30, 26 and 28 are shown. For clarity, the racquet string is not shown in FIG. 4. The cantilevered members 56 are shown in a preloaded position, wherein the string tension applied to the string bed (see FIG. 2) during the racquet stringing process creates a slight deflection or movement of the cantilevered members 56 in response to the application of string tension. This pre-load deflection can be used to facilitate the alignment of the outer peripheral surface 70 of the cantilevered member 56 with the outer peripheral surface of the head portion 18. Further, this pre-load feature may also be used as a technique for gauging the string tension of the string bed in the racquet. Overtime, and as a racquet is used, the tension of the main and cross string segments 44 and 46 forming the string bed can decrease. Accordingly, it is common for the racquet string to be replaced on a periodic basis to ensure proper tension and resiliency is maintained on the racquet. As the string tension decreases, the amount of pre-load deflection of the cantilevered member 56 will also decrease thereby allowing the second section 60 of the cantilevered member 56 to extend slightly outward with respect to the string bed 14. This deflection of the cantilevered member 56 can be used to gauge or monitor the string tension on the string bed 14, so that when the cantilevered member 56 outwardly extends to a predetermined position, such position of the cantilevered member 56 can be used as a signal to inform the user to replace the racquet's string. Alternatively, the cantilevered member can be formed of a material that does not exhibit a pre-load deflection.

Figure 11:
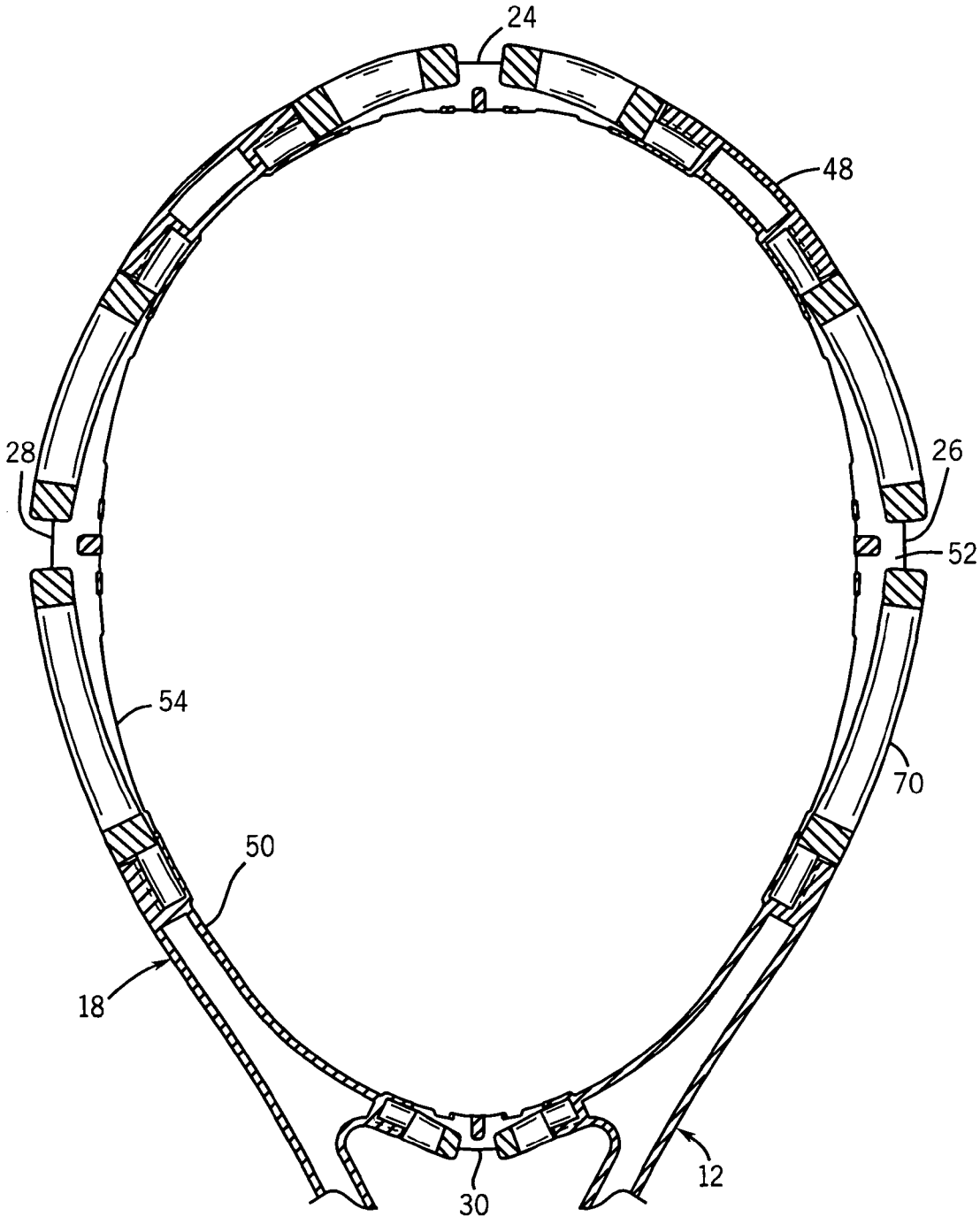
FIG. 11 is a front sectional view of the head portion of the racquet as viewed from line 4-4 of FIG. 3, shown without racquet string and its corresponding string tension.

Referring to FIG. 11, the head portion 18 of the racquet 10 is shown with the cantilevered members 56 installed without strings and prior to the application of string tension onto the cantilevered members 56 applied during stringing of the racquet 10. Without the tension of the strung racquet string, the cantilevered members 56 can extend slightly outward such that the outer surface 70 of the cantilevered members do not generally follow the contour of the outer peripheral surface of the head portion 18.

Referring to FIGS. 5 and 6, the operation of the cantilevered member 56 is illustrated. FIG. 5 illustrates the first side region 26 of the head portion 18, one of the cantilevered members 56 and the string bed 14 prior to impact with a tennis ball (not shown), and FIG. 6 illustrates the position of the cantilevered member 56 upon impact with the ball.

Referring to FIG. 6, the impact of the tennis ball on the string bed 14 applies a force that draws or deflects the cantilevered member 56 inward generally toward the location of the impact on the string bed 14. The inward movement of the cantilevered member 56 enables the cross string segments 46 adjacent the cantilevered member 56 to move generally toward the center, as indicated by the arrows adjacent the cross string segments 46. The deflection of the cantilevered member 56 can extend as far as the stop 72, which serves to inhibit further inward deflection of the cantilevered member 56. In a preferred embodiment, the second section 60 of the cantilevered member 56 further includes a pair of pads 74 positioned on the sides of the cantilevered member 56 generally parallel to a plane defined by the string bed. The pads 74 are formed of a wearable material, such as an elastomeric material. Alternatively, the pads can be formed of a textile material, a foam material, a plastic material, or combinations thereof. The pads 74 are configured to contact one or more inside surfaces of the head portion 18 to dampen, moderate and/or slow down the movement or deflection of the second section 60 of the cantilevered member 56 relative to the head portion 18. Accordingly, the pads 74 can serve to reduce shock and vibration, and to alter or improve the sound, of the racquet during play. In alternative preferred embodiments the pads 74 can be sized to generally fill a portion of, or substantially all of the clearance existing between the cantilevered member and the head portion of the frame. The pads can extend over all or a portion of the exposed surfaces of the cantilevered members. The pads can be unsecured separate members or secured to one or both of the frame and the cantilevered member.

In an alternative preferred embodiment, the head portion of the racquet can be formed without a stop and/or without one or more of the pads, thereby allowing the cantilevered member to deflect freely and to deflect further inward into the string bed area. In alternative preferred embodiments, a single pad, or three or more pads, can be applied to each cantilevered member. In another alternative embodiment, a dampener or other form of pad can be positioned on the head portion to operably engage the cantilevered member. Following impact with the ball, the cantilevered member 56 returns to its original position, as shown in FIG. 5.

Referring to FIGS. 7 and 8 and FIGS. 9 and 10, enlarged views of the cantilevered members 56 positioned in the distal and proximal regions 24 and 30 of the head portion 18, respectively, are shown. The size of the cantilevered members 56 in the distal region 24 is smaller than the cantilevered member 56 in the first side region 26, and the size of the cantilevered member 56 in the proximal region 30 is smaller than each of the cantilevered members 56 in the distal and first side regions 24 and 26. In alternative embodiments having alternative head portion configurations, the cantilevered members can be formed of different sizes and with different size relationships with respect to each other. Each of the cantilevered members 56 in the distal and proximal regions 24 and 30 engage one or more of main string segments 44. The attachment, configuration and operation of the cantilevered members 56 in the distal and proximal regions 24 and 30 is generally the same as the cantilevered members 56 of the first and second side regions 26 and 28.

The inward movement or deflection of the second section 60 of the cantilevered members 56 relative to the head portion 18 enables the string bed 14 to deflect further upon impact with the ball and thereby to provide more responsiveness and transfer more power to the ball. Further, the increased deflection of the string bed 14 increases the "dwell time," or the duration of contact between the ball and the string bed 14 of the racquet 10 upon contact, enabling the user to impart spin more easily to the ball and to achieve better overall control of the ball during play. The cantilevered member 56 further provides for increased string segment movement for string segments positioned further along the length of the cantilevered member 56, or graduated levels of deflection along the length of the cantilevered member 56. For example, the cross string segment extending through the racquet string hole 62 closest to the first section 58 of the cantilevered member 56 will deflect inward by an amount that is less than the deflection amount of the string hole 62 furthest from the first section 58. This characteristic applies to every string segment extending through a string hole 62 of the cantilevered member 56. Those string segments that are closer to the first section 58 will deflect, or extend inward, by an amount that is less than the string segments positioned in the string holes 62 positioned further away from the first section 58.

This graduated or generally increasing level of inward movement or deflection further enables the racquet to be specifically tailored to meet the needs of a particular player or market segment. The incorporation of cantilevered members 56 into the configuration of the head portion 18 of the racquet 10 allows for greater customization and flexibility to the racquet design. Several characteristics of the cantilevered members 56 can be varied and adjusted to provide a large variety of different racquet designs and different performance characteristics. For example, by positioning the cantilevered members 56 at different locations about the head portion 18 and in different orientations, the performance can be adjusted and tuned to meet different objectives or needs of a player or group of players. Further, the length, size, flexibility and/or material composition of the cantilevered members 56 can be varied in order to achieve varying response characteristics, including the size of the sweet spot of the racquet and the responsiveness, power and control of the racquet. Moreover, the number of string segments engaging the cantilevered members 56 can be varied to produce different performance characteristics.

The incorporation of one or more cantilevered members into the head portion of the racquet provides the racquet with improved performance. The cantilevered members can provide an effect that is similar to the effect achieved with longer racquet string segments or a larger hoop or string bed. The present invention provides this significant advantage without requiring an increase in the size of the head portion and the corresponding undesirable increase in the polar moment of inertia of the racquet.

Figure 12:
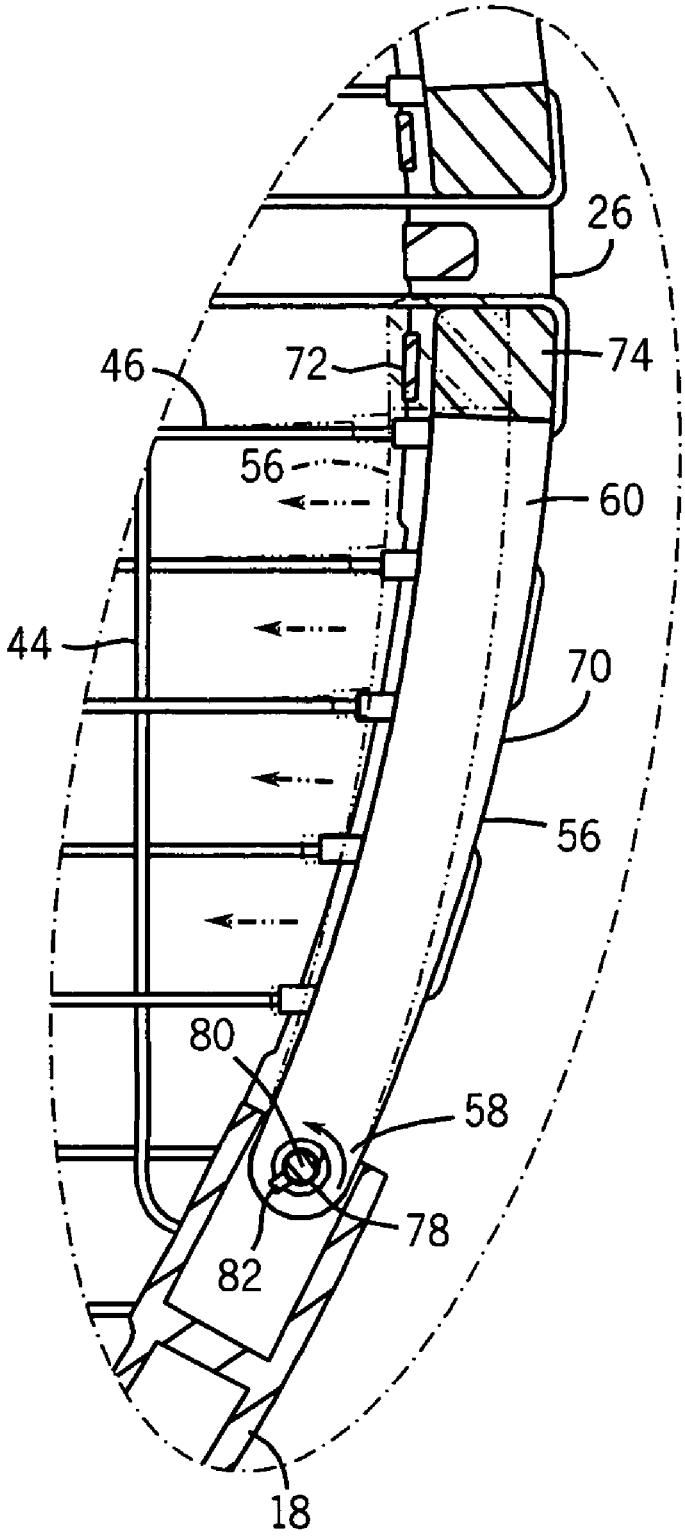
FIG. 12 is an enlarged front view of a first side region of the head portion in accordance with an alternative preferred embodiment of the present invention.

Referring to FIG. 12, an alternate preferred embodiment is illustrated wherein the cantilevered member 56 is pivotally coupled to the head portion 18. The first section 58 of the cantilevered portion 56 includes an aperture 78 for receiving a pin 80. The first section 58 is positioned in the desired location within the head portion 18 and the pin 80 is inserted through the head portion 18 and the aperture 78 to pivotally secure the first section 58 to the head portion 18. The cantilevered member 56 can be formed of a more rigid material, such that in lieu of deflecting inward upon the application of load, the cantilevered member 56 can rotate or pivot inwardly. A spring 82, or other biasing or resistance mechanism, can be used to at least partially counter the pre-load applied to the cantilevered member 56 by the string tension and the impact load during play. The spring 82, or other biasing or resistance mechanism, can also be used to return, such as spring-return, the cantilevered member into its original position prior to impact with a game ball. In an alternative preferred embodiment, the cantilevered member can be configured and installed such that it can deflect and pivot in response to the application of a load.

FIGS. 1-4 illustrate a racquet 10 having a total of eight cantilevered members 56, two at each region of the head portion 18. In alternative preferred embodiments, each region (the distal region 24, the first and second side regions 26 and 28 and the proximal region 30) can include various numbers of cantilevered members ranging from zero to ten, and combinations thereof. Accordingly, in alternative preferred embodiments, one or more cantilevered members can be positioned only in the distal region 24, only in the proximal region, only in the distal and proximal regions 24 and 30, or only in the first and/or second side regions 26 and 28. Further, in other alternative preferred embodiments, one or more cantilevered members can be positioned in all but one region of the head portion. The present invention allows for a wide range of potential arrangements and configurations of the cantilevered members on or about the head portion of a racquet, thereby maximizing the flexibility of the racquet design and allowing the racquet to be customized or tailored to meet the needs of a particular player or type of player.

Figure 13:
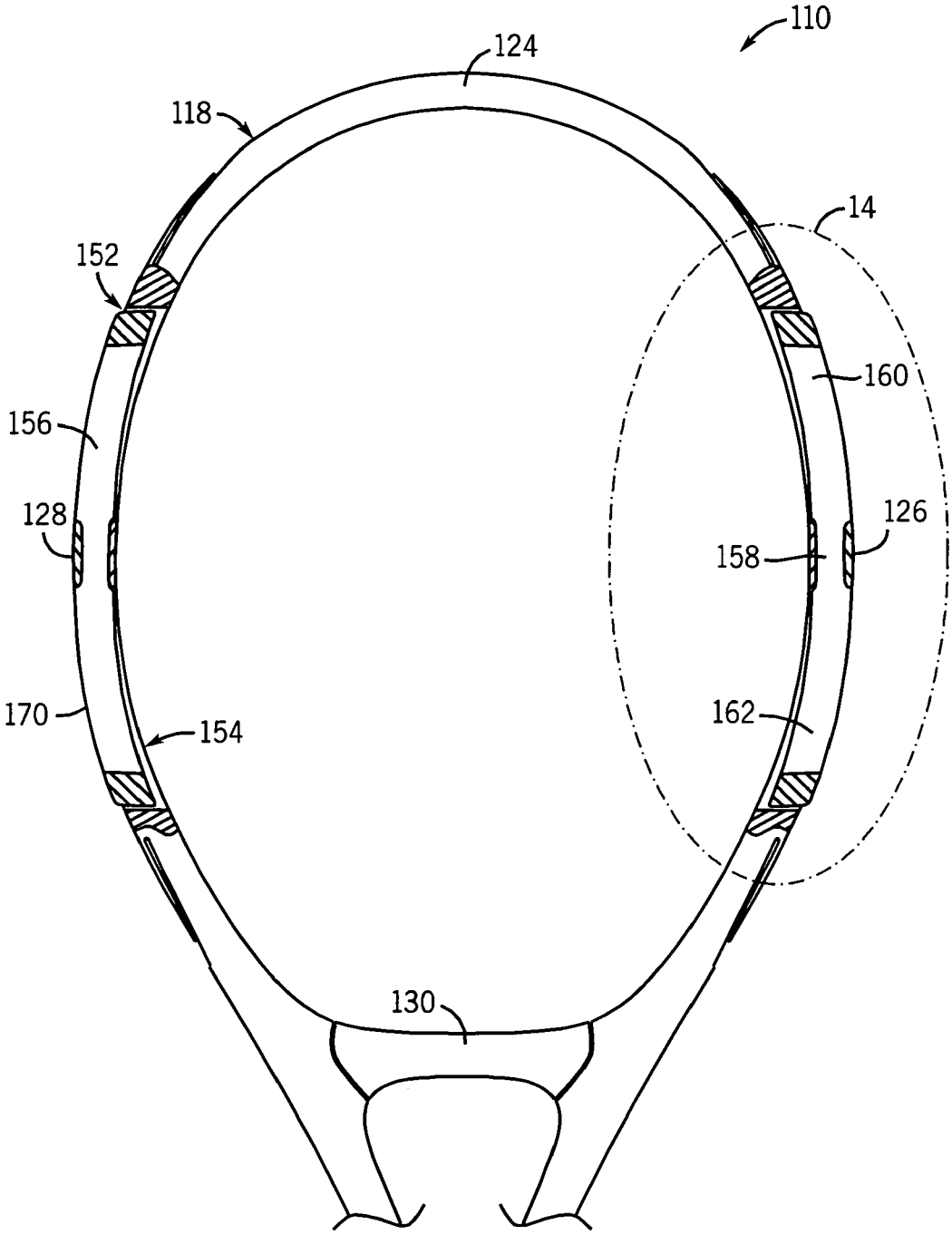
FIG. 13 is a front sectional view of the head portion of a racquet, shown without racquet string, and in accordance with an alternative preferred embodiment of the present invention.
Figure 14:
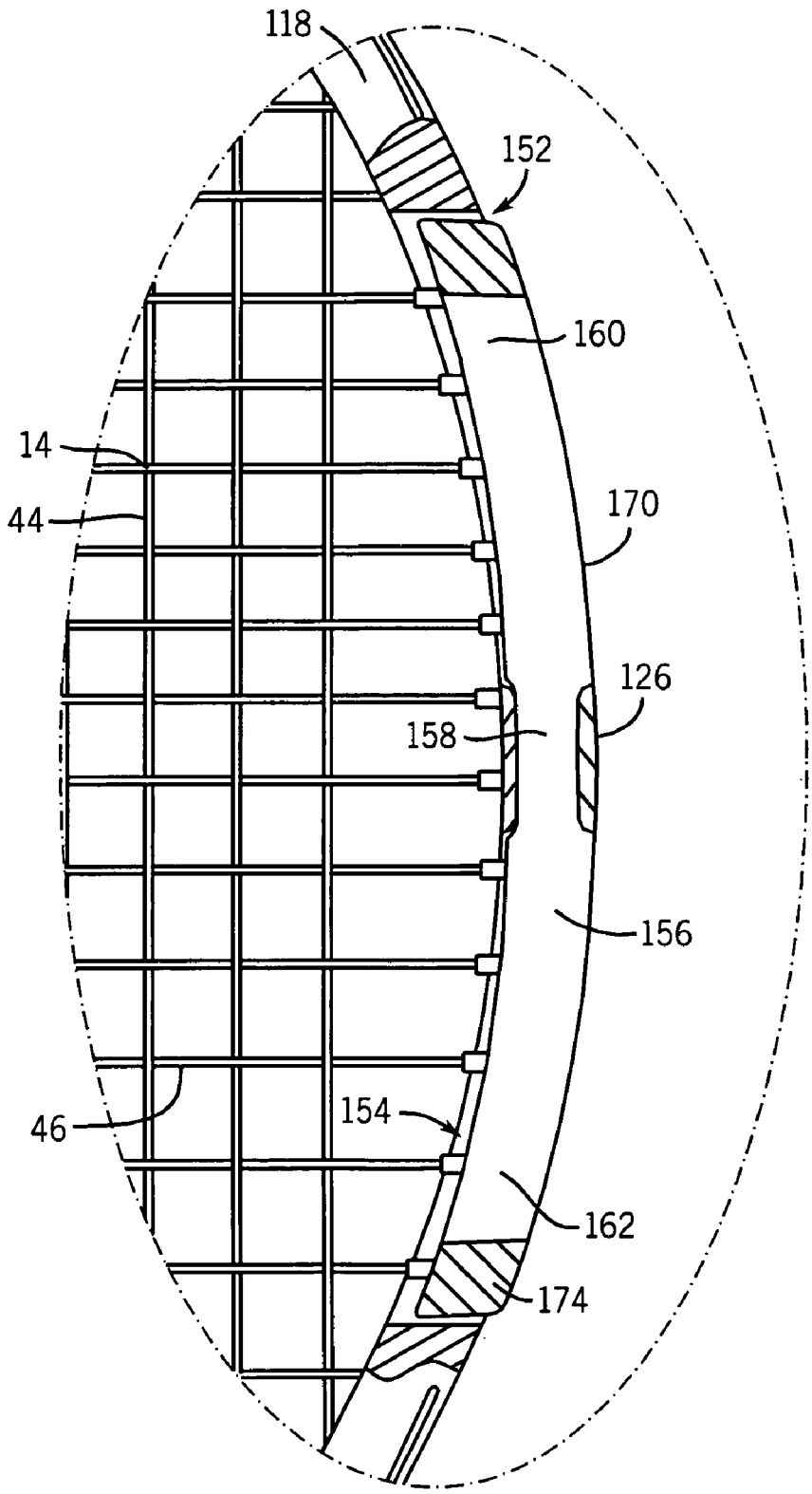
FIG. 14 is an enlarged front view of a first side region of the head portion viewed from oval 14 of FIG. 13, wherein the head portion includes racquet string and is shown in a condition prior to impact with a ball.
Figure 15:
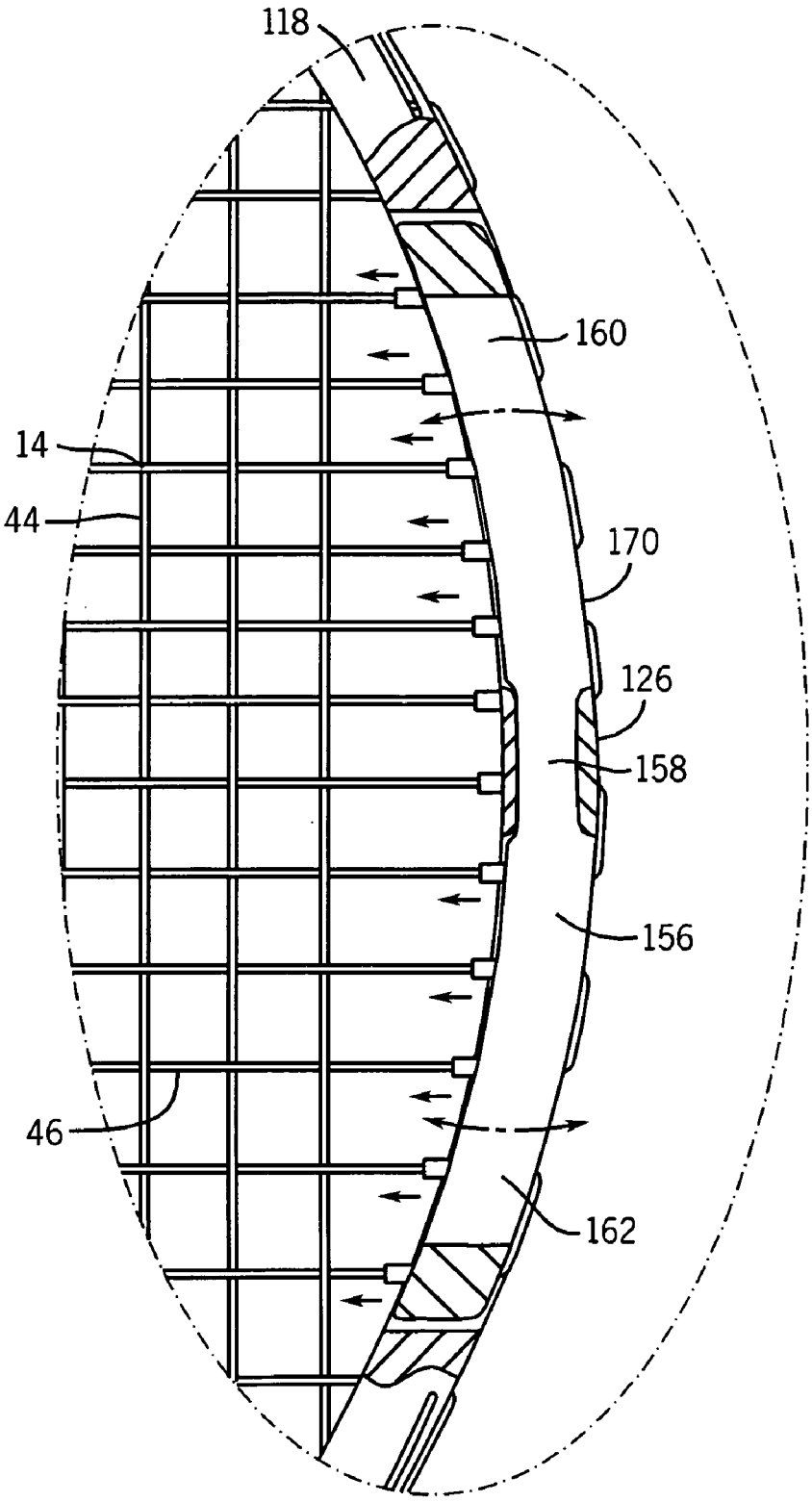
FIG. 15 is an enlarged front view of the first side region of the head portion viewed from oval 14 of FIG. 13, wherein the head portion includes racquet string and is shown in a condition during impact with a ball.

Referring to FIGS. 13-15, an alternative preferred embodiment of the present invention is illustrated. Referring to FIG. 13, a front view of a hoop portion 118 of a racquet 110 is shown without racquet string. The racquet 110 is substantially the same as the racquet 10 with like parts being substantially the same as the corresponding like parts. The racquet 110 includes first and second side regions 126 and 128. Outer and inner wall openings 152 and 154 are formed into outer and inner walls 148 and 150 of the head portion 118. Each of the first and second side regions 126 and 128 includes at least one cantilevered member 156. The cantilevered member 156 has a first section 158 that is coupled to the head portion 118, and second and third sections 160 and 162 extending from opposite ends of the first section 158. Like the first section 58, the first section 158 can also be coupled to the head portion in a variety of different ways. Each of the second and third sections 160 and 162 is configured to inwardly move or deflect upon the application of a load the string bed 14. The cantilevered member 156 provides two deflecting ends as opposed to a single deflecting end of the cantilevered member 156. The cantilevered member 156 can also include two or more pads 174 for dampening the operation of the second and third sections 160 and 162 of the cantilevered member 156

The configuration of cantilevered member 156 allows for additional alternate configurations of the cantilevered members about the head portion. The orientation of the single cantilevered member 156 on the first side region 126 is the opposite configuration of the two cantilevered members 56 coupled to the first side region 26 of the head portion 18 (see FIG. 11). Accordingly, different sections or groups of racquet string segments or different areas of the string bed can be targeted for improved or increased responsiveness. In one configuration, the cantilevered members can be arranged so as to improve the flexibility and responsiveness of the string bed in locations surrounding the sweet spot in an effort to enlarge the sweet spot or to improve the responsiveness and performance characteristics of the racquet for ball impact occurring at locations outside of the typically generally centrally located sweet spot.

Referring to FIG. 14 the cantilevered member 156 and the first side region 126 of the racquet 10 are shown with racquet string. The centrally positioned first section 158 of the cantilevered member 156 is fixedly coupled to the head portion 118. The second and third sections 160 and 162 of the cantilevered member 156 are each pre-loaded by the string tension of the cross-string segments 46, such that an outer surface 170 of the cantilevered member 156 generally conforms with the outer peripheral surface of the head portion 118. Referring to FIG. 15, the cantilevered member 156 is shown in an inwardly deflected position in response to the impact of a ball (not shown) with the string bed 14. The arrows adjacent to the cross-string segments 46 illustrate the inward movement of the respective cross-string segments 46 in response to the inward deflection of the cantilevered member 156. In alternative preferred embodiments, one or more of the cantilevered members 156 can be coupled to one or more locations on the proximal and distal regions 124 and 130 of the head portion 118. Alternatively, one or more cantilevered members 156 of one or more sizes can be used at one or more regions of the racquet. In other alternative preferred embodiments, members can be supported to the frame at two or more spaced apart locations such that intermediate portions of the members can deflect inward during impact in response to an impact with the ball. The members can be cantilevered at one or both ends, or the spaced-apart supports can be positioned at the ends of the member allowing for of the member at one or more locations between the ends of the member.

Figure 16:
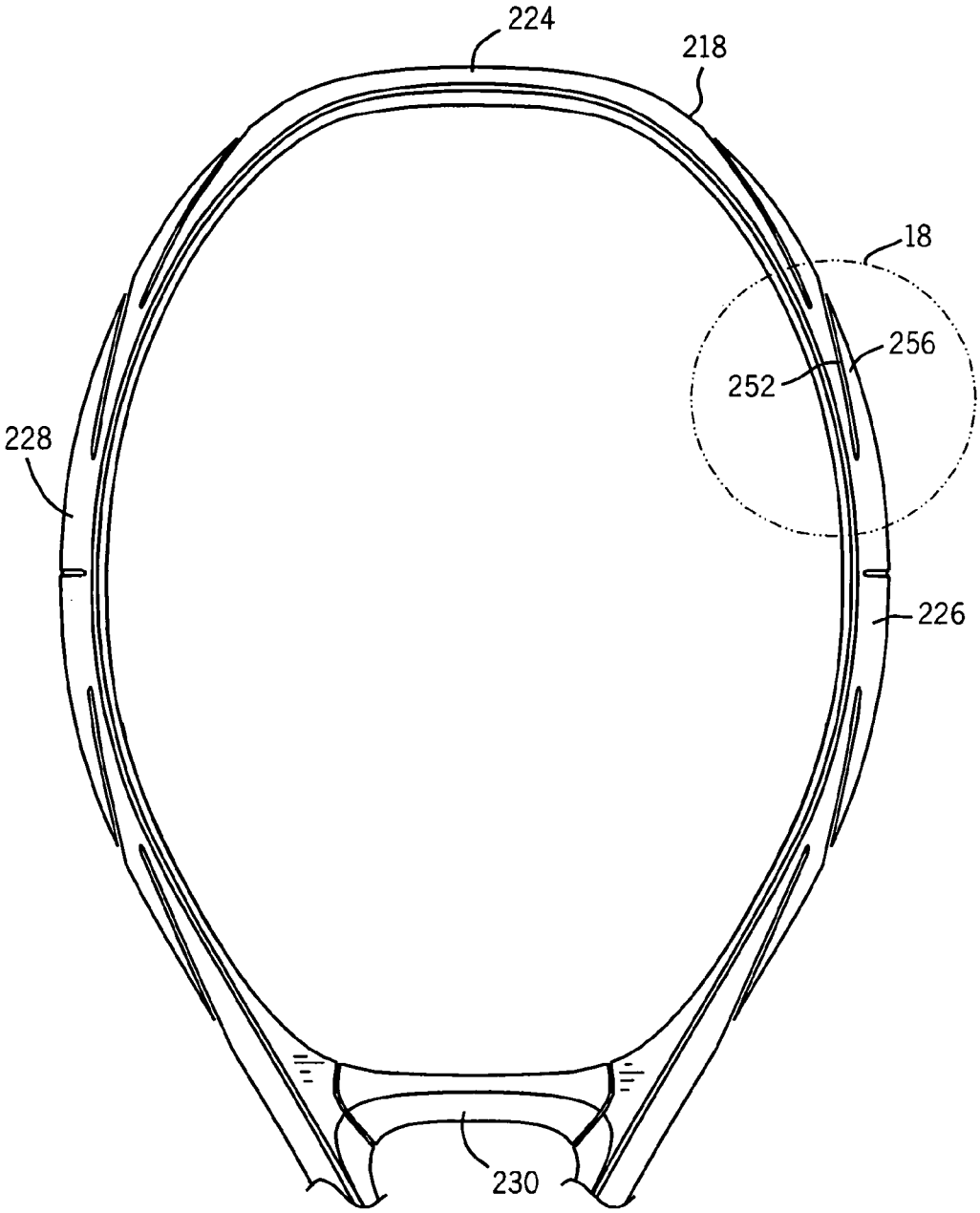
FIG. 16 is a front view of a head portion of a racquet in accordance with another alternative preferred embodiment of the present invention.

Referring to FIGS. 16-19, another alternative preferred embodiment of the present invention is illustrated. The racquet 210 is substantially the same as the racquet 10 with like parts being substantially the same as the corresponding like parts. Referring to FIG. 16 a front view of a head portion 218 of a racquet 210 is shown. The head portion 218 includes a distal region 224, first and second side regions 226 and 228 and a proximal region 230. A plurality of slots 252 are formed into the first and second side regions 226 and 228. The slots 252 extend into the head portion 218 a predetermined distance and help define a plurality of generally "scalloped shaped", or generally curved and projecting, cantilevered portions 256 about the first and second side regions 226 and 228. The predetermined distance can be within the range of 0.5 inches to 8.0 inches. In a more preferred embodiment, the predetermined distance is within the range of 2.0 to 5.0 inches. The cantilevered portions 256 can be integrally formed with the head portion 218, or formed as one or more separate pieces coupled to the head portion 218. The cantilevered members 256 can be fixedly coupled or movably coupled to the head portion 218. The slots 252 on the distal half of the head portion 218 extend into the head portion 218 in a generally proximal direction and the slots 252 in the proximal half of the head portion extend into the head portion 218 in a generally distal direction to provide a particular arrangement to the cantilevered portions 256 and to target particular cross-string segments 44.

Figure 17:
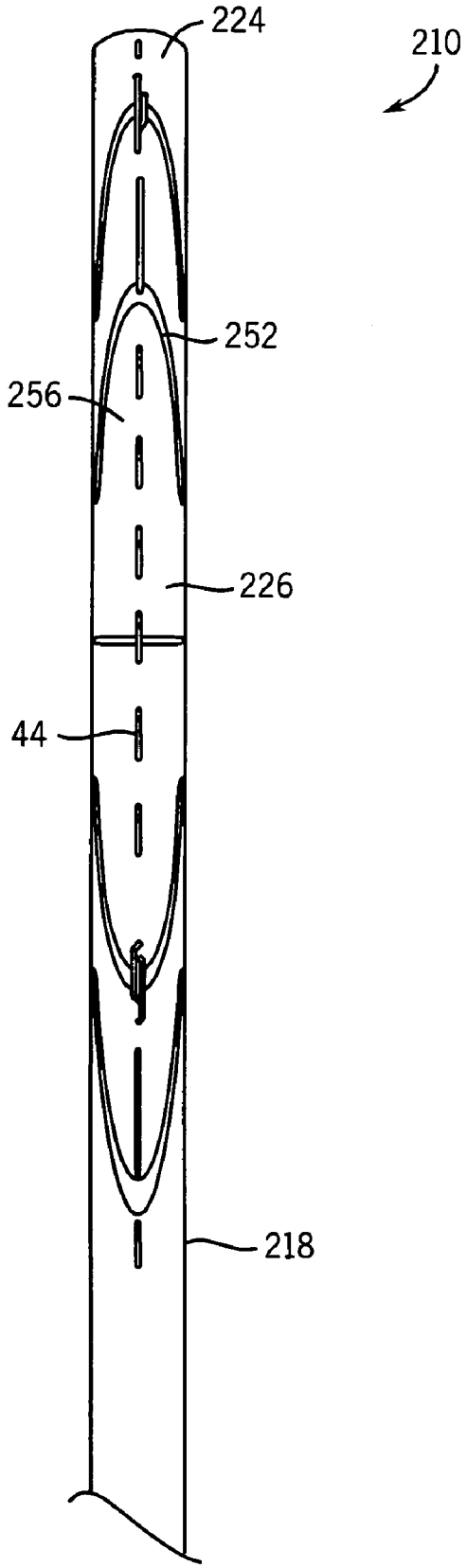
FIG. 17 is a side view of the head portion of the racquet of FIG. 16.

Referring to FIGS. 16 and 17, the slots 252 and the cantilevered members 256 provide a unique pleasing aesthetic appearance to the racquet 210. In alternative preferred embodiments, one or more cantilevered members 256 can be formed or coupled to one or more locations on the proximal and distal regions 224 and 230 of the head portion 218. Alternatively, one or more cantilevered members 256 of one or more sizes can be used at one or more regions of the racquet.

Figure 18:
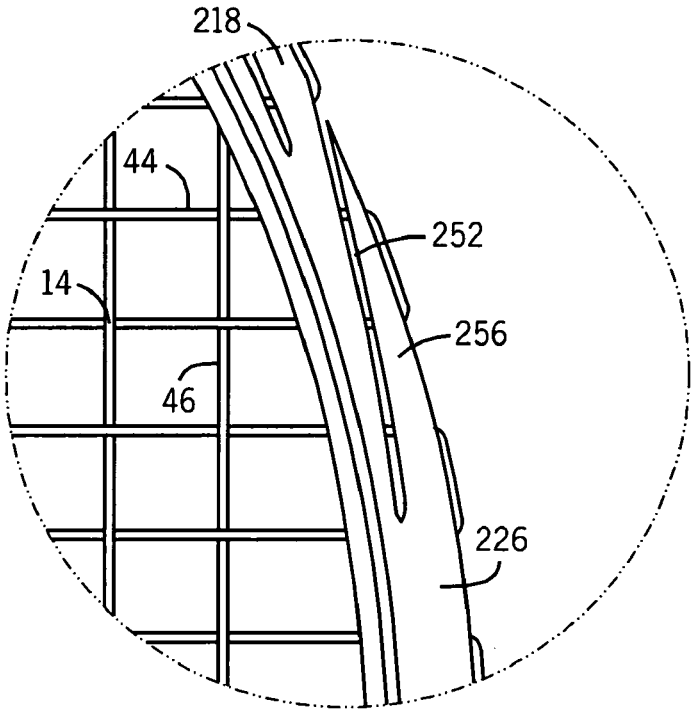
FIG. 18 is an enlarged front view of a portion of a first side region of the head portion viewed from circle 18 of FIG. 16, wherein the head portion includes racquet string and is shown in a condition prior to impact with a ball.
Figure 19:
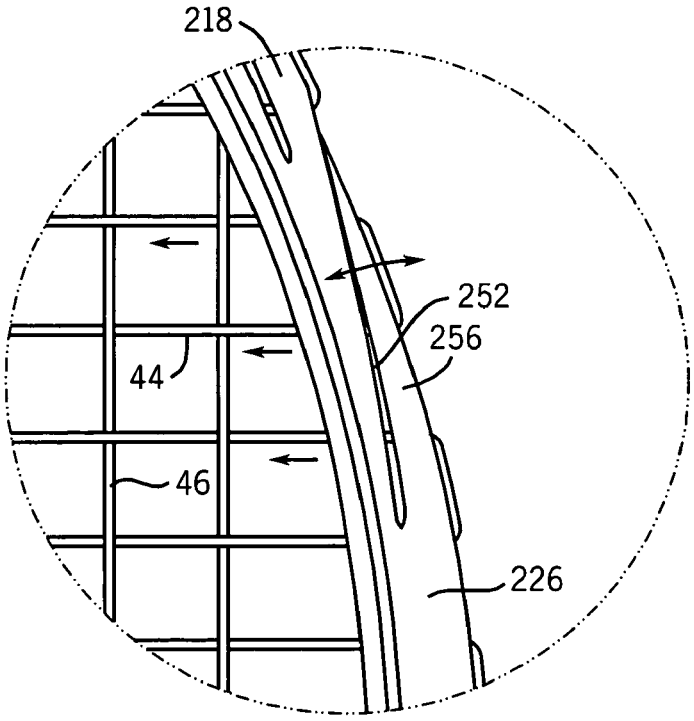
FIG. 19 is an enlarged front view of the first side region of the head portion viewed from circle 18 of FIG. 16, wherein the head portion includes racquet string and is shown in a condition during impact with a ball.

Referring to FIGS. 18 and 19, the operation of the cantilevered member 256 is shown. In FIG. 18 the cantilevered member 256 is shown in a strung condition prior to impact with a ball. In FIG. 19, the cantilevered member 256 is shown during impact with a ball (not shown). The cantilevered portion 256 includes string holes 262 for receiving main or cross string segments 44 and 46. The racquet is shown without a grommet strip. However, a grommet strip can also be used with the cantilevered member 256. The slot 252 spaces the cantilevered portion 256 from the head portion 218. Upon impact with the ball, the cantilevered portion 256 deflects, or moves, inward toward the string bed 14. The head portion 218 can serve as a stop to inhibit or stop the inward deflection of the cantilevered member 256. The size and width of the slot 252 can be varied to allow for varied amounts of deflection or movement of the cantilevered member 256 to occur.

Figure 20:
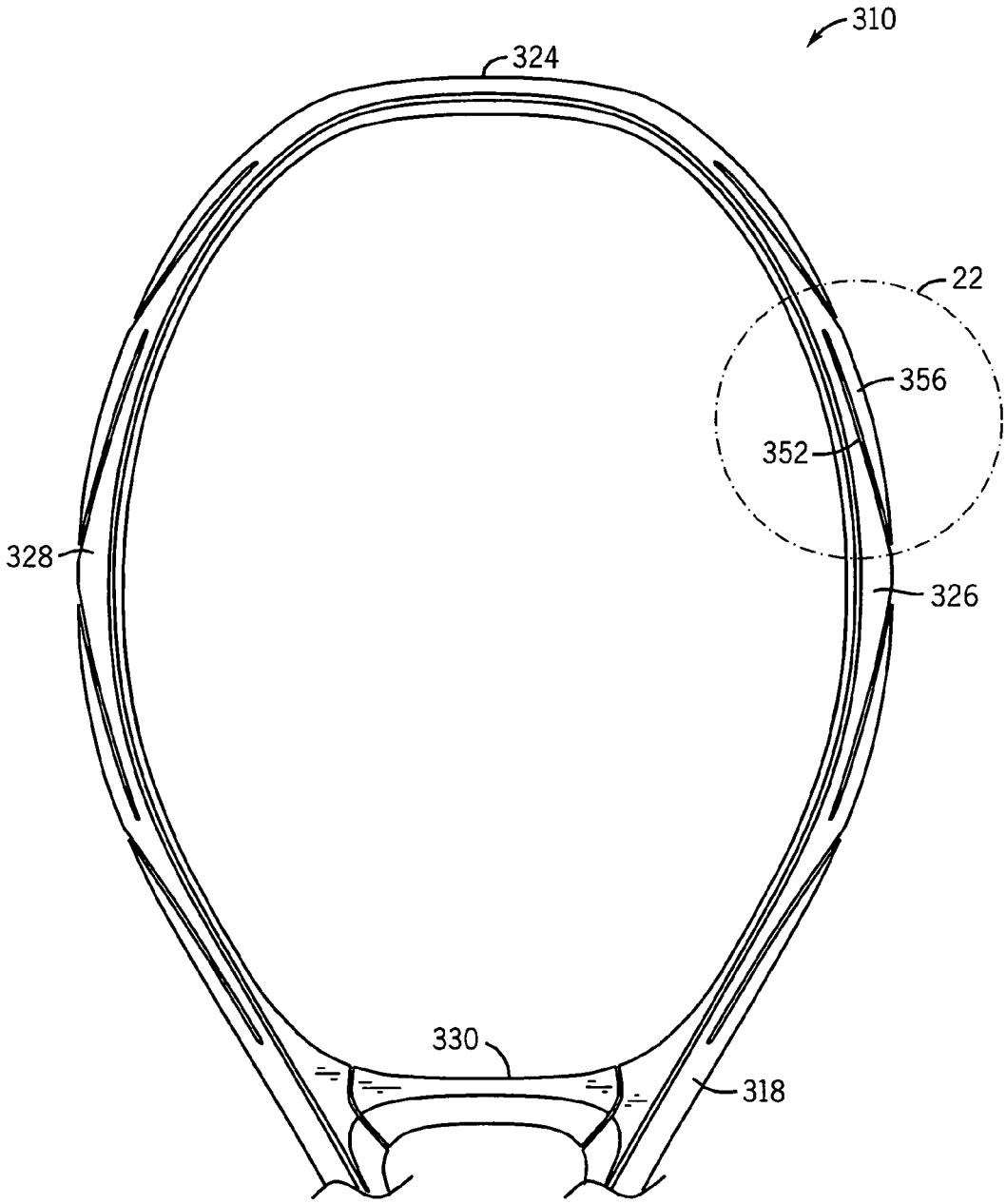
FIG. 20 is a front view of a head portion of a racquet in accordance with another alternative preferred embodiment of the present invention.

Referring to FIGS. 20-23, another alternative preferred embodiment of the present invention is illustrated. The racquet 310 is substantially the same as the racquet 10 and racquet 210 with like parts being substantially the same as the corresponding like parts. Referring to FIG. 20 a front view of a head portion 318 of a racquet 310 is shown. The head portion 318 includes a distal region 324, first and second side regions 326 and 328 and a proximal region 330. A plurality of slots 352 are formed into the first and second side regions 326 and 328. The slots 352 extend into the head portion 318 a predetermined distance and help define a plurality of generally "scalloped shaped", or generally curved and projecting, cantilevered portions 356 about the first and second side regions 326 and 328. The predetermined distance can be within the range of 0.5 inches to 8.0 inches. In a more preferred embodiment, the predetermined distance is within the range of 2.0 to 5.0 inches. The cantilevered portions 356 can be integrally formed with the head portion 318, or formed as one or more separate pieces coupled to the head portion 318. The cantilevered members 356 can be fixedly coupled or movably coupled to the head portion 318. The slots 352 on the distal half of the head portion 318 extend into the head portion 318 in a generally distal direction and the slots 352 in the proximal half of the head portion extend into the head portion 318 in a generally proximal direction to provide a particular arrangement to the cantilevered portions 356 and to target particular cross-string segments 44.

Figure 21:
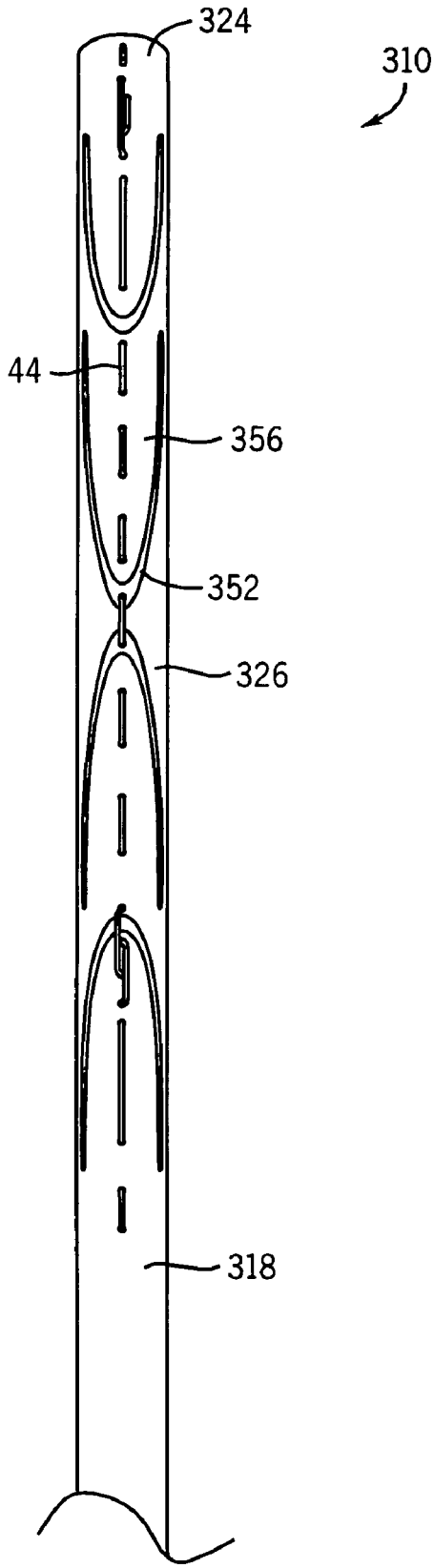
FIG. 21 is a side view of the head portion of the racquet of FIG. 20.

Referring to FIGS. 20 and 21, the slots 352 and the cantilevered members 356 provide a unique pleasing aesthetic appearance to the racquet 310. In alternative preferred embodiments, one or more cantilevered members 356 can be formed or coupled to one or more locations on the proximal and distal regions 324 and 330 of the head portion 318. Alternatively, one or more cantilevered members 356 of one or more sizes can be used at one or more regions of the racquet.

Figure 22:
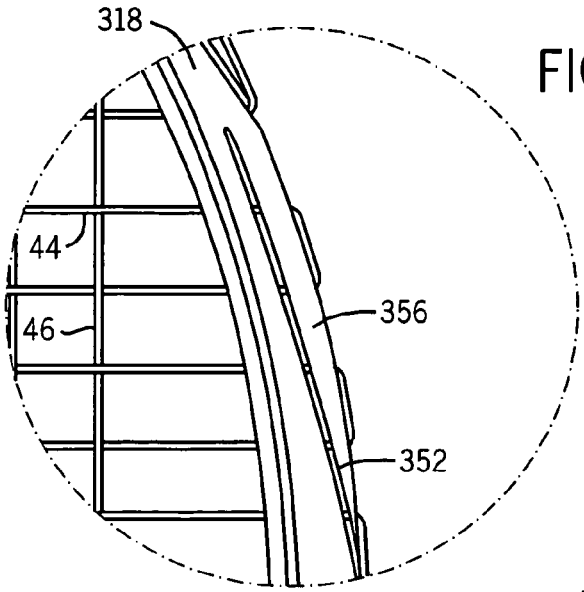
FIG. 22 is an enlarged front view of a portion of a first side region of the head portion viewed from circle 22 of FIG. 20, wherein the head portion includes racquet string and is shown in a condition prior to impact with a ball.
Figure 23:
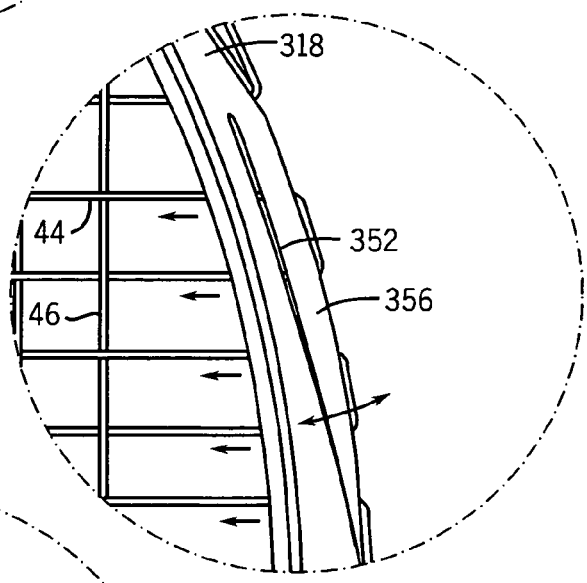
FIG. 23 is an enlarged front view of the first side region of the head portion viewed from circle 22 of FIG. 20, wherein the head portion includes racquet string and is shown in a condition during impact with a ball.

Referring to FIGS. 22 and 23, the operation of the cantilevered member 356 is shown. In FIG. 22 the cantilevered member 356 is shown in a strung condition prior to impact with a ball. In FIG. 23, the cantilevered member 356 is shown during impact with a ball (not shown). The cantilevered member 356 includes string holes for receiving main or cross string segments 44 and 46. The slot 352 spaces the cantilevered member 356 from the head portion 318. Upon impact with the ball, the cantilevered portion 356 deflects, or moves, inward toward the string bed 14. The head portion 318 can serve as a stop to inhibit or stop the inward deflection of the cantilevered member 356. The size and width of the slot 352 can be varied to allow for varied amounts of deflection or movement of the cantilevered member 356 to occur.

Figure 24:
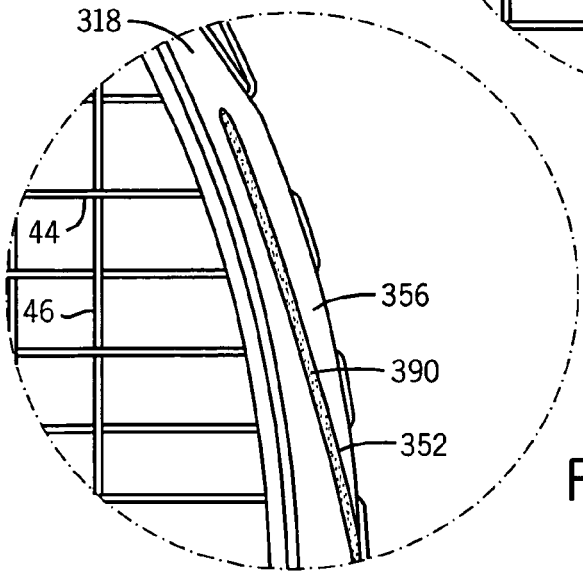
FIG. 24 is an enlarged front view of a portion of a first side region of the head portion of a racquet in accordance with another alternative preferred embodiment of the present invention.

Referring to FIG. 24, in another alternative preferred embodiment, the slot 352 can be partially, or substantially, filled with a filling element 390. The filling element 390 can be used to alter, dampen, and/or moderate the movement of the cantilevered member 356 during use. The filling element 390 is preferably formed of a compressible, resilient material such as an elastomeric material. Alternatively, the filling element 390 can be formed of other material, such as, for example, a textile material, a foam, a gel, a plastic, or rubber. The filling element 390 can be used to reduce the shock and/or vibration felt by the user during use of the racquet or can be used to alter or improve the sound of the racquet during use.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A sports racquet for impacting a game ball, the racquet comprising:

a frame including a head portion coupled to a handle portion, the head portion including a distal region, first and second side regions, and a proximal region, the head portion defining a single hoop having a continuous closed curved shape that defines a string bed area;

a string bed formed of a plurality of cross string segments and a plurality of main string segments; and at least one cantilevered member, the member having a first section coupled to at least one of the regions of the head portion such that at least one point on the first section remains substantially fixed in relation to the region to which the first section is coupled, and a second section that is deflectable relative to the region to which the first section is coupled, at least one of the string segments being operably engaged with the at least one member, such that when the ball impacts the at least one string segment, the second section of the member deflects inward toward the string bed.

2. The sports racquet of claim 1, wherein the at least one cantilevered member includes first and second cantilevered members coupled to the first and second side regions, respectively.

3. The sports racquet of claim 2, wherein the at least one cantilevered member includes third and fourth cantilevered members coupled to the distal and proximal regions, respectively.

4. The sports racquet of claim 1, wherein the first section of the at least one cantilevered member is fixedly secured to head portion.

5. The sports racquet of claim 1, wherein the first section of the at least one cantilevered member is integrally formed to head portion.

6. The sports racquet of claim 1, wherein the first section of the at least one cantilevered member is pivotally coupled to head portion.

7. The sports racquet of claim 1, wherein the second section of the at least one cantilevered member includes at least one free end unconnected to the head portion.

8. The sports racquet of claim 7, wherein the at least one cantilevered member further includes a third section, opposite the second section, and wherein the third section s deflectable relative to the at least one region of the head portion.

9. The sports racquet of claim 1, wherein the at least one cantilevered member includes at least one string passage for engaging at least one string segment of the string bed.

10. The sports racquet of claim 9, wherein the at least one cantilevered member includes at least one string groove for receiving a string segment.

11. The sports racquet of claim 1, wherein the cantilevered member includes at least two string passages for engaging at least two string segment of the string bed.

12. The sports racquet of claim 1, wherein the at least one cantilevered member is formed of a resilient material.

13. The sports racquet of claim 1, wherein the proximal region of the head portion includes a yoke, and wherein the cantilevered member is coupled the yoke.

14. The sports racquet of claim 1, wherein the continuous closed curved shape of the hoop of the head portion is selected from group consisting of a generally oval shape, a tear drop shape, a pear shape, a generally circular shape and combinations thereof.

15. The sports racquet of claim 1, further comprising a filling element positioned between a portion of the cantilevered member and the head portion.

16. The sports racquet of claim 15, wherein the filling element is formed of a material selected from the group consisting of an elastomer, a rubber, a foam, a gel, a textile, a plastic or combinations thereof.

17. The sports racquet of claim 1, wherein the head portion and the at least one cantilevered member define at least one opening, and wherein the at least one opening is at least partially filled with a filling element.

18. A sports racquet for impacting a game ball, the racquet comprising:

a frame including a head portion coupled to a handle portion, the head portion including a distal region, first and second side regions, and a proximal region;

a string bed formed of a plurality of cross string segments and a plurality of main string segments; and at least one cantilevered member, the member having a first section coupled to at least one of the regions of the head portion such that at least one point on the first section remains substantially fixed in relation to the region to which the first section is coupled, and a second section that is deflectable relative to the region to which the first section is coupled, at least one of the string segments being operably engaged with the at least one member, such that when the ball impacts the at least one string segment, the second section of the member deflects inward toward the string bed, the at least one cantilevered member including first and second cantilevered members coupled to the first and second side regions, respectively, and third and fourth cantilevered members coupled to the distal and proximal regions, respectively.

19. A sports racquet configured to support a string bed formed of a plurality of cross string segments and a plurality of main string segments and for impacting a game ball, the racquet comprising:

a frame including a head portion coupled to a handle portion, the head portion including a distal region, first and second side regions, and a proximal region, the head portion defining a single hoop having a continuous closed curved shape that defines a string bed area; and at least one cantilevered member having first and second sections, the first section being coupled to the at least one of the regions of the head portion such that at least one point on the first section remains substantially fixed in relation to the region to which the first section is coupled, the member having a second section that is unconnected to, and movable relative to, the region to which the first section is coupled, at least one of the string segments being operably engaged with the second section of the at least one member, such that when the ball impacts the at least one string segment, the second section of the member moves inward toward the string bed.

20. The sports racquet of claim 19, wherein the at least one cantilevered member includes first and second cantilevered members coupled to the first and second side regions, respectively.

21. The sports racquet of claim 20, wherein the at least one cantilevered member includes third and fourth cantilevered members coupled to the distal and proximal regions, respectively.

22. The sports racquet of claim 20, wherein the at least one cantilevered member includes third and fourth cantilevered members coupled to the distal and proximal regions, respectively.

23. The sports racquet of claim 19, wherein the first section of the at least one cantilevered member is coupled to the head portion in a manner selected from the group consisting of being fixedly secured to head portion, being integrally formed to the head portion, being pivotally coupled to the head portion, and combinations thereof.

24. The sports racquet of claim 19, wherein the second section of the at least one cantilevered member includes a free end unconnected to the head portion.

25. The sports racquet of claim 24, wherein the at least one cantilevered member further includes a third section, opposite the second section, and wherein the third section is movable relative to the at least one region of the head portion.

26. The sports racquet of claim 19, wherein the at least one cantilevered member includes at least one string passage for engaging at least one string segment of the string bed.

27. The sports racquet of claim 26, wherein the at least one cantilevered member includes at least one string groove for receiving a string segment.

28. The sports racquet of claim 19, wherein the cantilevered member includes at least two string passages for engaging at least two string segment of the string bed.

29. The sports racquet of claim 19, wherein the at least one cantilevered member is formed of a resilient material.

30. The sports racquet of claim 19, wherein the proximal region of the head portion includes a yoke, and wherein the cantilevered member is coupled the yoke.

31. The sports racquet of claim 19, wherein the continuous closed curved shape of the hoop of the head portion is selected from group consisting of a generally oval shape, a tear drop shape, a pear shape, a generally circular shape and combinations thereof.

32. A sports racquet configured to support a string bed formed of a plurality of cross string segments and a plurality of main string segments and for impacting a game ball, the racquet comprising:

a frame including a head portion coupled to a handle portion, the head portion including a distal region, first and second side regions, and a proximal region;

at least one cantilevered member having first and second sections, the first section being coupled to the at least one of the regions of the head portion such that at least one point on the first section remains substantially fixed in relation to the region to which the first section is coupled, the member having a second section that is unconnected to, and movable relative to, the region to which the first section is coupled, at least one of the string segments being operably engaged with the second section of the at least one member, such that when the ball impacts the at least one string segment, the second section of the member moves inward toward the string bed; and a filling element positioned between a portion of the cantilevered member and the head portion.

33. The sports racquet of claim 32, wherein the filling element is formed of a material selected from the group consisting of an elastomer, a rubber, a foam, a gel, a textile, a plastic or combinations thereof.

34. A sports racquet configured to support a string bed formed of a plurality of cross string segments and a plurality of main string segments and for impacting a game ball, the racquet comprising:

a frame including a head portion coupled to a handle portion, the head portion including a distal region, first and second side regions, and a proximal region;

at least one cantilevered member having first and second sections, the first section being coupled to the at least one of the regions of the head portion such that at least one point on the first section remains substantially fixed in relation to the region to which the first section is coupled, the member having a second section that is unconnected to, and movable relative to, the region to which the first section is coupled, at least one of the string segments being operably engaged with the second section of the at least one member, such that when the ball impacts the at least one string segment, the second section of the member moves inward toward the string bed; and the head portion and the at least one cantilevered member define at least one opening, and the at least one opening being at least partially filled with a filling element.

35. The sports racquet of claim 34, wherein the at least one opening is a slot.

* * * * *